United States Patent [19]

Hussamy

[11] Patent Number: 4,631,067

[45] Date of Patent: Dec. 23, 1986

[54] DISCHARGE PRINT PASTE AND METHOD OF USING SAME FOR THE DISCHARGE PRINTING OF SYNTHETIC TEXTILE MATERIALS

[75] Inventor: Samir Hussamy, Lynchberg, Va.

[73] Assignee: Burlington Industries, Inc., Greensboro, N.C.

[21] Appl. No.: 720,736

[22] Filed: Apr. 8, 1985

[51] Int. Cl.[4] ..... D06P 5/15

[52] U.S. Cl. ..... 8/464; 8/466; 8/598; 8/599; 8/922; 8/924; 8/937

[58] Field of Search ..... 8/464

[56] References Cited

U.S. PATENT DOCUMENTS

| | | | |
|---|---|---|---|
| 4,406,661 | 9/1983 | Buhler et al. | 8/464 |
| 4,421,516 | 12/1983 | Stahl et al. | 8/464 |
| 4,428,750 | 1/1984 | Birke et al. | 8/464 |

*Primary Examiner*—A. Lionel Clingman

*Attorney, Agent, or Firm*—Cushman, Darby & Cushman

[57] ABSTRACT

Disperse dyes are dischargeable to white with a print paste including a thickening agent, lithium hydroxide, an organic acid, a polyethylene glycol compound, a polyoxyethylene sorbitan fatty acid ester and a polyalkyleneglycol ether. The print paste discharges a number of known disperse dyes, some which have been conventionally thought of as being alkali-resistant. A method of discharge printing of synthetic textile materials (e.g. polyester) is also disclosed.

16 Claims, No Drawings

DISCHARGE PRINT PASTE AND METHOD OF USING SAME FOR THE DISCHARGE PRINTING OF SYNTHETIC TEXTILE MATERIALS

FIELD OF INVENTION

The present invention relates to a novel print paste for the discharge printing of textile materials made of synthetic fibers so as to achieve desired patterns, motiffs, and the like.

In particular, the present invention relates to the surprising discovery that particular print paste formulations are functional so as to cause the alkali-discharge of disperse dyestuffs to white in synthetic textile materials, some of the dyestuffs useable with the present invention having conventionally been thought of as being alkali-resistant. In accordance with the present invention therefore, an expanded range of disperse dyestuffs used as ground shades can now be utilized in accordance with this invention for the alkali-discharge printing of synthetic textile materials.

BACKGROUND AND SUMMARY OF THE PRESENT INVENTION

Discharge printing is a well known technique in the textile industry for the production of white and colored sharply outlined patterns which are characterized by close-fitting, fine details, and small motiffs on contrasting color (usually darker) ground shades. It is broadly known therefore that such designs may be produced by printing a discharge print paste in a desired pattern onto the darker-colored ground shade produced with a dyestuff which is dischargeable to white when the paste-printed textile material is subjected to high-temperature steaming so as to permit the discharge agent in the print paste to distroy the dyestuff in those areas of the print pattern. The use of dyestuffs which are resistant to the discharge agent in the print paste are also known so that when the ground shade is discharged to white, the discharge-resistant dyestuff (conventionally known as a "reservable dyestuff") remains as a visible contrasting color to the ground color.

With the advent of synthetic fiber textile materials, problems were encountered in discharging ground shades of disperse dyes which are fixed to the synthetic fibers (conventionally termed "fully dyed"). Accordingly, the discharge printing of synthetic textile materials, for example, polyesters, fully dyed with disperse dyestuffs presented significant problems to those in this art. Fully-dyed synthetic textile materials (i.e., those textile materials in which the dyestuffs are fixed or dissolved in the synthetic fibers) are resistant to attack by discharge agents in the aqueous discharge paste due to the highly crystalline structure and hydrophobic nature of the synthetic fibers, particularly, the polyesters.

To overcome this problem, the discharge print process was modified by first padding the textile material with a dye liquor containing a disperse dyestuff and then drying or superficially drying the material at temperatures so as to prevent fixation of the dyestuff in the synthetic fiber. A desired pattern could then be printed onto the textile material with the non-fixed dyestuff therein so that when the padded and printed fabric is subsequently subjected to high-temperature steaming, the dyestuff will be discharged to white in the pattern areas of the print paste prior to its fixation in the synthetic fibers. The high-temperature steaming concurrently causes the nonpattern areas of the dyestuff to be fixed in the synthetic fibers so that upon subsequent rinsing, a white pattern area or contrasting color pattern area (if a reservable dye is included in the ground dyestuff) results. In this regard, the reader's attention is directed to U.S. Pat. Nos. 3,972,677 and 4,252,530, the disclosure of each being expressly incorporated hereinto by reference.

The discharge printing method described immediately above whereby disperse dyestuffs are discharged prior to their fixation in the synthetic fibers of the textile material has been conventionally termed "discharge-resist printing" and this term will be utilized herein to distinguish it from the classical discharge printing technique whereby fully dyed fabrics with fixed dyestuffs are pattern printed with a discharge paste and then discharged via high temperature steaming.

Discharge-resist printing, however, while overcoming many disadvantages associated with discharge printing of synthetic textile materials in accordance with the classical discharge printing technique is not without problems of its own. For example, when discharge-resist printing is attempted to be utilized for light-weight synthetic fabrics (i.e., less than about 40 grams per square yard), shading problems occur due to mechanical difficulties encountered when ground shades are padded onto the fabric and to dyestuff migration during the superficial drying step which thus leads to an unsatisfactory textile product. Moreover, it is not easy to completely destroy or discharge the ground dyestuff even when it is not fixed in the synthetic fibers without the use of strong reducing agents or oxidizing agents. Use of strong reducing or oxidizing agents is disadvantageous since they also attack the synthetic fibers per se thereby prejudicing their use with light-weight synthetic fabrics. Moreover, heavy metal salts such as stannous chloride are typically used in discharge resist printing so as to completely destroy the ground dyestuff (see, U.K. Pat. No. 1,412,681 and U.K. Pat. No. 1,440,904). Use of stannous chloride however is very corrosive to processing equipment and results in heavy metal effluent disposal problems. Moreover, the use of stannous chloride as a discharge agent is typically restricted to the use of anthraquinone disperse dyestuffs when colored discharges are required and which are available commercially in much smaller numbers than the more plentiful azo disperse dyestuffs.

Alkali-dischargeable dyestuffs have also been proposed for use in the discharge resist printing techniques as described in, for example, U.K. Pat. No. 1,543,724 and U.S. Pat. No. 4,252,530, the disclosure of each being expressly incorporated hereinto by reference. Alkali dischargeable disperse dyestuffs having carboxylic acid ester groups of the type disclosed in U.K. Pat. No. 1,543,724 are, however, very sensitive to hydrolysis and require careful handling and strict control of pH and the use of sodium or potassium dichromate during processing which presents effluent disposal problems. Additionally, dyestuffs having carboxylic acid ester groups exhibit an affinity for nylon and hydrophilic natural fibers, such as cotton and rayon, after saponification of the ester groups during alkali treatment and thus tend to dye or stain these types of fibers causing so-called "halation" or the lowering of the sharpness of the pattern. Accordingly, such carboxylic acid ester group disperse dyes are typically not utilized to discharge print fabric blends of synthetic and natural fibers. In addition, diazo components and the coupling components required for the manufacture of dyestuffs containing carboxylic acid ester groups are specialty items thereby often times ruling out their use as being excessively expensive. Accordingly, only a very limited number of carboxylic acid ester group-containing disperse dyes is presently commercially available, namely CI disperse yellow 126, CI disperse orange 127, CI disperse red 278 and 311, CI disperse blue 284 and 288, CI disperse green 9 and CI disperse brown 19. *

* The source of all color indices used herein is "Color Index", 3rd edition (1971).

Recently, it has been proposed that classical discharge printing of fully-dyed (i.e., fixed) lightweight polyester fabrics can be accomplished utilizing the carboxylic acid ester group-containing disperse dyestuffs of U.K. Pat. No. 1,543,724 in conjunction with a specially-formulated discharge paste which contains an alkali (preferably sodium hydroxide) together with a blend of ethoxylated products and polyols (i.e., Matexil PNAD and Matexil PN-DG, Imperial Chemical Industries PLC) as described in Brierley et al, "The Use of Disperse Dyes Containing Diester Groups to Produce Discharge Effects on Fully Dyed Lightweight Polyester Fabrics", JSDC, Vol. 99, pages 358–363 (Dec. 1983), the entire content thereof being expressly incorporated hereinto by reference. The alkali print paste proposed by Brierley et al however, appears to be suitable only for use with the carboxylic acid ester group-containing dyestuffs of the type described in U.K. Pat. No. 1,543,724 which, as indicated previously, are available in limited quantities and tend to be rather expensive due to their chemically special nature.

Utilizing the above discussion as a background, the reader will undoubtedly appreciate that discharge printing of a hydrophobic synthetic material to overcome the above disadvantages has been needed for some time.

DETAILED DESCRIPTION OF THE PREFERRED EXEMPLARY EMBODIMENTS

The present invention relates to the surprising discovery that disperse dyes (some of which have been conventionally thought of as being alkali-resistant) for synthetic textile fabrics are nonetheless capable of being discharged by use of a specially-formulated discharge print paste. Accordingly, synthetic textile fabrics can now be discharge printed in accordance with the present invention thereby providing the discharge printer with a wide choice of dischargeable disperse dyes. Moreover, since the use of strong reducing and oxidizing agents is avoided by the present invention, lightweight synthetic fabrics can now be readily discharge printed.

The discharge print paste of the present invention when utilized for the discharge printing of ground-dyed synthetic textile materials includes a thickening agent, lithium hydroxide, an organic acid, a polyethylene glycol compound, a polyoxyethylene sorbitan fatty acid ester, and a polyalkylene glycol ether. When utilized for the discharge resist printing of an unfixed ground-dyed synthetic textile material, the print paste will be an aqueous paste which preferably includes about 50 parts by weight of a thickening agent, about 13 parts by weight of lithium hydroxide, and about 12 parts by weight of a reducing agent, such as thiourea dioxide, glucose and/or anthraquinone.

The thickening agent can be any of the conventional thickeners for print pastes usable for discharge printing of synthetic textile materials such as natural starch, British gum, crystal gum, natural and etherified locust bean gums, carboxymethyl cellulose, gum tragacanth, polyacrylic acid sodium salt and/or sodium alginate. Preferably, the thickening agent will comprise an aqueous solution of carboxymethyl cellulose and modified starch and will be present in an amount sufficient so that the resulting print paste will have a viscosity ranging between 5,000–36,000 cps.

The organic acid will preferably be present in the print paste in an amount between 5 to 10 parts by weight. Preferred for use in the present invention are organic acids selected from the group consisting of ethanedioic acid, hydroxyacetic acid propanoic acid (e.g. 2-hydroxy-1,2,3-propanetricarboxilic acid), butanedioic acid (e.g. 2,3-dihydroxybutanedioic acid) and butenedioic acid, with 2,3-dihydroxy butanedioic acid being particularly preferred.

Any suitable polyethylene glycol compound of the general formula $HOCH_2(CH_2OCH_2)_nCH_2OH$ where n is an integer can be utilized in the successful practice of the invention. The polyethylene glycol compound should have a molecular weight between 400 to 8,000 and be present in the print paste in an amount between 5 to 10 parts by weight. A non-ionic water soluable surface active agent of the polyoxyethylene sorbitan fatty acid ester group of compounds is also present in an amount between 5 to 10 parts by weight of the print paste. The fatty acid ester of the polyoxyethylene sorbitan fatty acid ester compound can be a laurate, palmitate, stearate, tristearate, oleate, or trioleate with polyoxyethylene sorbitan laurate being particularly preferred.

Additionally, a polyalkylene glycol ether in an amount between 5 to 10 parts by weight of the print paste is present. Preferred for use in the present invention is alkyloxy (polyethylenoxypropylenoxy)isopropanol having a molecular weight between 600–700. Auxiliary chemicals can be added as desired and can include oxidizing agents and/or reducing agents in an amount not greater than about 5 by weight parts each. Suitable oxidizing agents include a persulphate or perchlorate of sodium, potassium, lithium and ammonium while suitable reducing agents include thiorea dioxide, glucose or anthraquinone.

As is conventional, a reservable disperse dye resistant to the print paste can be formulated with the print paste components and can be applied to the synthetic textile fabric concurrently with the print paste so that when the ground disperse dye is discharged, a contrasting color to the ground color will be present.

The process of the invention can be conveniently carried out, for example, by exhaust dyeing the synthetic textile material and then fixing the ground dyestuff following conventional practices normally employed in synthetic fabric dying with disperse dyestuffs. The dyebath may contain one or more of the dischargeable disperse dyestuffs dischargeable to white by the print paste of the present invention (which form the ground shade) in addition to dyeing auxillaries, such as carriers, dispersing and leveling agents and defoamers. The synthetic textile fabric can be conventionally dyed at 120°–130° C. for 1–1½ hours followed by frame drying to remove creases at 160°–190° C.

The fully ground-dyed textile material can then be printed in a pattern in those portions of the synthetic fabric where a white discharge effect is required with the discharge print paste discribed above. The paste-printed textile fabric can then be superficially dried at 110°-140° C. followed by high-temperature steaming for 6-10 minutes at a temperature of between about 115° C. to 210° C. during which the ground dyestuff in contact with the print paste is discharged to white (i.e., destroyed). Subsequent washing to remove any residual unfixed dyestuffs, decomposition products and impurities from the textile material followed by final drying will result in a synthetic textile fabric having desirable white print patterns on a colored ground.

When colored discharge effects are required within the ground shade so as to provide colored patterns contrasting with the ground shade, the discharge print paste can be formulated to include a disperse dyestuff for the synthetic textile material which is resistant to the discharge print paste. Alternatively, a reservable disperse dyestuff can be applied together with the dischargeable disperse dyestuff forming the ground shade in which case the ground shade is dyed with a combination of both types of dyestuffs (i.e., one or more dischargeable dyestuffs together with one or more reservable dyestuffs). Table III by way of example lists various dyestuffs found to be resistant to the print paste of the present invention.

The synthetic textile materials for which the present invention is particularly well suited can be in any suitable structural form, i.e., nonwoven, felt, and carpet materials or woven and knitted fabrics. The invention is particularly well-suited for light-weight textile materials (i.e., less than 45 grams per square yard) but could also advantageously be utilized in heavy weight textile materials (i.e., greater than 180 grams per square yard). Particularly perferred synthetic fibers forming the textile materials usable with the present invention include aromatic polyester fibers, and polyamides (e.g., fabric produced by duPont under the registered trademark Qiana.

The process of the invention can also be conveniently carried out by way of conventional discharge-resist printing techniques. For example, the fabric can have the ground shade padded thereon via a pad roller/screen on the print machine with a dye liquor which contains one or more of the dischargeable disperse dyestuffs listed in Tables I and II below, in addition to customary dyeing and padding auxiliaries such as thickeners, carriers, antimigrants, humectants and defoamers, the pad-dyed fabric can then be superficially dried at 100°-130° C. to avoid premature fixation of dyestuffs, and then printed in those portions where white or colored patterns are required with the discharge print paste of this invention. Drying of the printed fabric at 110°-140° C., and then high temperature steaming for 6-10 minutes at 170°-190° C. causes the disperse dystuffs which are not in contact with the print paste to be fixed on the textile material. The unfixed dyestuffs, any decomposition products and impurities are then removed from the textile fabric by a washing treatment. Again when a colored effect is desireable, one or more disperse dyestuffs for the textile material which are not adversely affected by the discharge print paste may be incorporated in the print paste formulation. Alternatively, such disperse dyestuffs can be applied together with the dischargeable disperse dyestuffs used for the coloration of the ground shade.

The dischargeable disperse dyestuffs used for the coloration of the ground shade according to the invention can be a dyestuff of any of the known classes of disperse dyestuffs and, in particular, of the nitro, quinoline, aminokitone, methine, azomethine, anthraquinone, and azo (specially monoazo) series. Such dyestuffs are those which are free from dicarboxylic acid ester groups which have typically been thought of as being alkali-resistant and thus unsuitable for use in discharge printing applications. By way of example, the dischargeable disperse dyestuffs which are dischargeable by the print paste according to the present invention are dyestuffs noted below in Tables I and II, while those dyestuffs resistant to the print paste (i.e. reservable) are noted below in Table III.

TABLE I

| Color Index No. | Chemical Class |
|---|---|
| C.I. Disperse Yellow 44 | Monoazo |
| C.I. Disperse Yellow 58 | Aminoketone |
| C.I. Disperse Yellow 64 | Quinoline |
| C.I. Disperse Yellow 124 | Lactone |
| C.I. Disperse Yellow 143 | Quinophthalone |
| C.I. Disperse Yellow 198 | Monoazo |
| C.I. Disperse Yellow 200 | Methine |
| C.I. Disperse Yellow 210 | Methine |
| C.I. Disperse Red 35 | Monoazo |
| C.I. Disperse Red 86 | Anthraquinone |
| C.I. Disperse Red 59 | Anthraquinone |
| C.I. Disperse Red 91 | Anthraquinone |
| C.I. Disperse Red 151 | Disazo |
| C.I. Disperse Red 159 | Anthraquinone |
| C.I. Disperse Red 263 | Anthraquinone |
| C.I. Disperse Blue 77 | Anthraquinone |
| C.I. Disperse Blue 79 | Monoazo |
| C.I. Disperse Blue 95 | Anthraquinone |
| C.I. Disperse Blue 102 | Monoazo |
| C.I. Disperse Blue 109 | Anthraquinone |
| C.I. Disperse Blue 121 | Azo |
| C.I. Disperse Blue 122 | Monoazo |
| C.I. Disperse Blue 130 | Monoazo |
| C.I. Disperse Blue 139 | Azo |
| C.I. Disperse Blue 165 | Monoazo |
| C.I. Disperse Blue 283 | Monoazo |

TABLE II

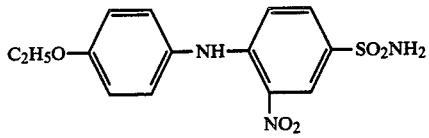

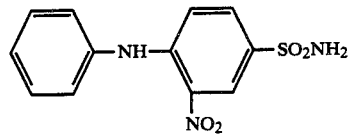

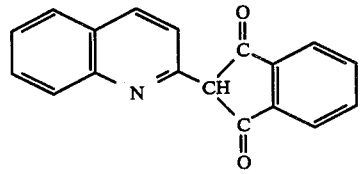

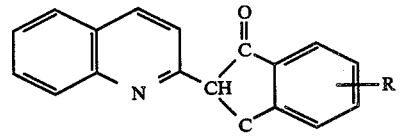

R = Br or Cl

TABLE II-continued

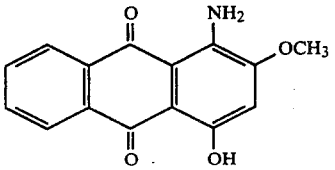

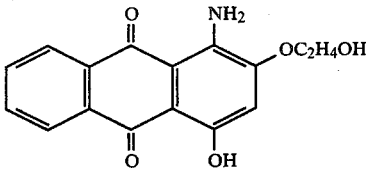

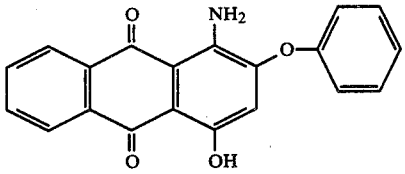

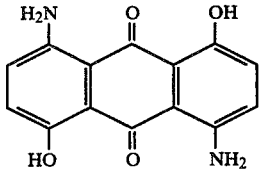

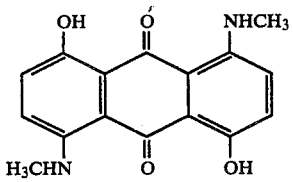

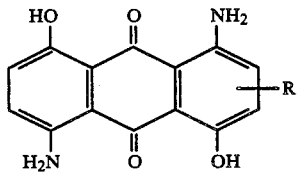

R = Br or Cl

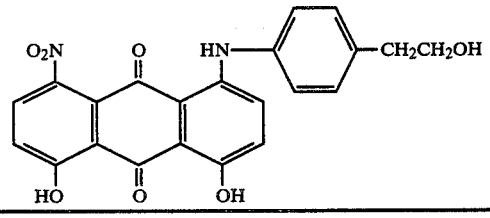

TABLE III

| Color Index No. |
|---|
| C.I. Disperse Yellow 13 |
| C.I. Disperse Yellow 74 |
| C.I. Disperse Yellow 77 |
| C.I. Disperse Yellow 88 |
| C.I. Disperse Yellow 82 |
| C.I. Disperse Yellow 108 |
| C.I. Disperse Yellow 182 |
| C.I. Disperse Yellow 199 |
| C.I. Disperse Orange 17 |
| C.I. Disperse Orange 25 |

TABLE III-continued

| Color Index No. |
|---|
| C.I. Disperse Orange 31 |
| C.I. Disperse Orange 32 |
| C.I. Disperse Orange 33 |
| C.I. Disperse Orange 44 |
| C.I. Disperse Orange 48 |
| C.I. Disperse Orange 53 |
| C.I. Disperse Orange 58 |
| C.I. Disperse Orange 59 |
| C.I. Disperse Orange 62 |
| C.I. Disperse Orange 66 |
| C.I. Disperse Orange 95 |
| C.I. Disperse Orange 98 |
| C.I. Disperse Red 1 |
| C.I. Disperse Red 11 |
| C.I. Disperse Red 65 |
| C.I. Disperse Red 108 |
| C.I. Disperse Red 117 |
| C.I. Disperse Red 177 |
| C.I. Disperse Red 303 |
| C.I. Disperse Red 316 |
| C.I. Disperse Blue 3 |
| C.I. Disperse Blue 87 |
| C.I. Disperse Blue 122 |

White or colored effects within a ground shade can thus be obtained by the present invention on synthetic textile materials, and the colorations so obtained have exhibited good color fastness.

EXAMPLES

The invention is further illustrated by way of the following nonlimiting examples in which the parts and percentages noted are by weight unless otherwise indicated.

EXAMPLE 1

A woven lightweight fabric made of polyethylene terephthalate continuous filament yarns, each yarn consisting of 34 filaments and having a 70 denier, is ground dyed at a temperature of 130° C. for 60 minutes sufficient to fix the dyestuffs to the fibers. The following dyestuffs composition is used:

C.I. Disperse Blue 283 (Latyl Navy EFSN): 1.5% OWF*

* OWF=On Weight of Fabric.

C.I. Disperse Yellow 44 (Esterophile Yellow 2RL): 2.0% OWF

The ground-dyed fabric is frame dried at 170° C. and is then printed in accordance with a predetermined pattern with a discharge print paste having the following composition:

| | |
|---|---|
| 7% aqueous solution of carboxymethyl Cellulose + modified starch | 55 parts |
| Lithium Hydroxide (57% strength) | 12 parts |
| 2,3-dihydroxybutanedioic acid | 7 parts |
| Polyethyleneglycol (M.W. 400) | 8 parts |
| Polyoxyethylene sorbitan laurate | 8 parts |
| Alkoxy (polyethylenoxypropylenoxy) isopropanol (M.W. 640) | 3 parts |
| Lithium perchlorate | 3 parts |
| Uvitex EBF (Optical Brightener Ciba Geigy) | 2 parts |
| Water | 2 parts |
| | 100 parts |

The fabric is then dried at 138° C. for 2 minutes, and subsequently subjected to high temperature steaming for 6 minutes at 183° C.

The steamed fabric is then rinsed in cold water, treated for 5 minutes in an aqueous solution of 0.2% caustic soda (pearl or flake), 0.2% sodium hydrosulphite, and 0.2% of a non-ionic detergent at 65° C., rinsed in hot water followed by cold water, and is finally dried.

A white design on a dark green ground is obtained.

EXAMPLE 2

The above procedure outlined in EXAMPLE 1 is repeated using the following dye composition for dyeing the ground shade.

C.I. Disperse Blue 283 (Latyl Navy EFSN): 1.5% OWF

C.I. Disperse Yellow 77 (Resolyn Yellow C6GL): 2% OWF

A yellow design on a dark green ground is obtained owing to the reservability (i.e. resistance to the print paste) of the C.I. Disperse Yellow 77 dyestuff.

EXAMPLE 3

A woven lightweight fabric made of polyethylene terephthalate continuous filament yarns, each yarn consisting of 47 filaments and having a 50 denier count is ground dyed and discharge printed as described in EXAMPLE 1 using 5 parts of C.I. Disperse Red 11 (Dispersol Powder Red B3B) in the discharge printing formula. A red design on a dark green ground is obtained owing to the reservability of the C.I. Disperse Red 11.

EXAMPLE 4

The above procedures outlined in EXAMPLE 1 are repeated using the dyestuffs listed below:

A. 1.5% OWF, yellow disperse dyestuff of the Formula;

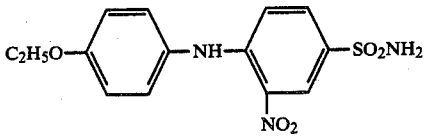

A White design on a yellow ground is obtained.

B. 3.0% OWF red disperse dyestuff of the Formula;

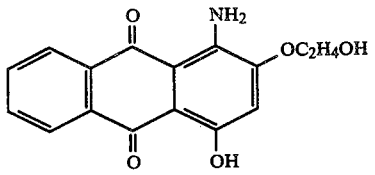

A white design on a prink ground is obtained.

C. 1.5% OWF blue disperse dyestuff of the Formula:

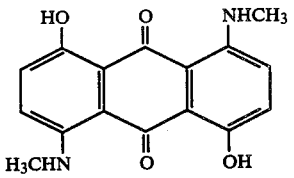

A white design on a blue ground is obtained.

D. 1.5% OWF blue disperse dyestuff of the Formula:

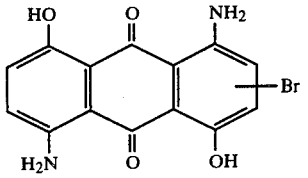

A white design on a blue ground is obtained

E. A 1.5% OWF blue disperse dyestuff of the Formula:

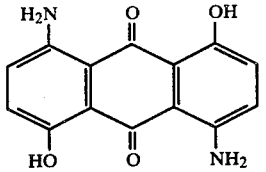

A white design on a blue ground is obtained.

EXAMPLE 5

The above procedures outlines in EXAMPLE 1 are repeated using the following two disperse dyestuffs for coloring the ground shade.

2.5% OWF

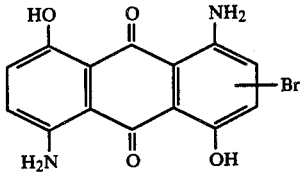

1.0% OWF

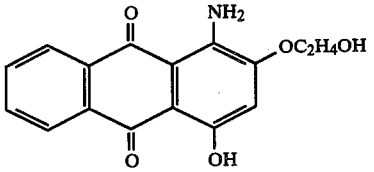

A white design on a navy blue ground is obtained.

EXAMPLE 6

The above procedures outlined in EXAMPLE 5 are repeated using 4 parts C.I. Disperse Red 316 (Sodycron Scarlet 2PY) in the discharge printing paste formula.

A bright scarlet design on a navy blue ground is obtained.

EXAMPLE 7

A polyethylene terephthalate woven textile material is padded into a padding liquor comprising:

| | |
|---|---|
| C.I. Disperse Red 224 (Palanil Red 3GL liquid) | 60.0 parts |
| 2% aqueous solution of sodium alginate | 120.0 parts |
| Monosodium phosphate | 0.5 parts |
| Water | 819.5 parts |

-continued

| | |
|---|---|
| | 1000.0 parts |

with a 60% pickup (on the weight of the fabric) and dried at 100° C. for 4 minutes without fixing the dyestuff to the fibers. The fabric is then printed in accordance with a predetermined pattern with a discharge printing paste having the following composition:

| | |
|---|---|
| 9% aqueous solution of Indalca ® PA3 locust bean gum ether | 50 parts |
| Lithium hydroxide | 13 parts |
| Glucose | 5 parts |
| Thiourea Dioxide | 7 parts |
| Water | 25 parts |
| | 100 parts |

The paste-printed fabric is dried at 138° C. for 2 minutes, high temperature steamed for 6 minutes at 183° C., rinsed in cold water, treated for 5 minutes in an aqueous solution of 0.2% caustic soda (pearl or flake), 0.2% sodium hydrosulphite and 0.2% of a non-ionic detergent at 65° C., sequentially rinsed in hot and cold water, and finally dried. A white design on a bright red ground is obtained.

EXAMPLE 8

A padding liquor comprising:

| | |
|---|---|
| 2% aqueous solution of Sodium Alginate | 120.0 parts |
| C.I. Disperse Blue 56 (Latyl Blue BCN powder) | 43.0 parts |
| C.I. Disperse Yellow 34 (Eastman Yellow 4RLF powder) | 60.0 parts |
| C.I. Disperse Red 224 (Palanil Red 3GL liquid) | 32.5 parts |
| Monosodium phosphate | 0.5 parts |
| Water | 744.0 parts |
| | 1000.0 parts |

is padded onto a polyethylene terephthalate woven textile material to 60% liquor pickup, and the textile material is dried and discharge printed as described in EXAMPLE 7. A white design on a black ground is obtained.

EXAMPLE 9

A polycarbonamide Qiana ® knit fabric is padded into a padding liquor comprising:

| | |
|---|---|
| 2% aqueous solution of Sodium Alginate | 120.0 parts |
| C.I. Disperse Blue 56 (Latyl Blue BCN powder) | 35.0 parts |
| C.I. Disperse Yellow 34 (Eastman Yellow 4RLF) | 25.0 parts |
| C.I. Disperse Red 224 (Palanil Red 3GL) | 20.0 parts |
| Monosodium phosphate | 0.5 parts |
| Water | 799.5 parts |
| | 1000.0 parts |

with a 60% pickup. The fabric is then dried at 100° C. for 4 minutes and printed in accordance with a predetermined pattern with a discharge printing paste having the following composition:

-continued

| | |
|---|---|
| 9% aqueous solution of Indalca ® PA3 locust bean gum ether | 50.0 parts |
| Lithium Hydroxide | 20.0 parts |
| Glucose | 5.0 parts |
| Thiourea dioxide | 7.0 parts |
| Water | 17.0 parts |
| | 100.0 parts |

The fabric is then dried, high temperature steamed, washed and dried as is carried out in EXAMPLE 7. A white design on a black ground is obtained.

EXAMPLE 10

The above procedures for Example 8 are repeated twice, one time using 4 parts C.I. Disperse Red 11 (Dispersol Red B3B powder) and the other time using 4 parts C.I. Disperse Yellow 199 (Samaron Yellow H10GF) in the discharge print formulation.

Red and bright yellow designs on a black ground are obtained, respectively.

What I claim is:

1. An aqueous discharge print paste consisting essentially of:

a thickening agent;

lithium hydroxide;

an organic acid selected from the group consisting of ethanedioic acid, hydroxyacetic acid, propionic acid, butanedioic acid, butenedioic acid and mixtures thereof, said organic acid being present in an amount of from about 5 to about 10 parts by weight of the print paste;

a polyethylene glycol compound having a molecular weight between 400–800, said polyethylene glycol compound being present in an amount between about 5 to about 10 parts by weight of the print paste;

at least one polyoxyethylene sorbitan fatty acid ester wherein the residue of the fatty acid moiety thereof is derived from lauric acid, plamitic acid, stearic acid, or oleic acid, said at least one polyoxyethylene sorbitan fatty acid ester being present in amount between about 5 to about 10 parts by weight of the print paste; and a polyalkylene glycol ether in an amount between about 3 to about 10 parts by weight of the print paste.

2. A print paste as in claim 1 in which the lithium hydroxide is present in an amount of between 1–20% wt/wt.

3. A print paste as in claim 1 wherein said butanedioic acid is 2,3-dihydroxybutanedioic acid.

4. A print paste as in claim 1 wherein said propanoic acid is 2-hydroxy-1,2,3-propanetricarboxylic acid.

5. A print paste as in claim 1 in which the polyalkylene glycol ether is alkyloxy (polyethylenoxpropylenoxy) isopropanol having a molecular weight between 600–700.

6. A print paste as in claim 1, said print paste containing an oxidizing agent or a reducing agent.

7. A print paste as in claim 6 in which the oxidizing agent is a persulphate or perchlorate of sodium, potassium, lithium, or ammonium.

8. A print paste as in claim 6 in which the reducing agent is thiourea dioxide, glucose or anthraquinone, in an amount not greater than about 5 parts by weight.

9. A method for the discharge printing of a fixed ground-dyed textile material containing synthetic fibers to achieve a white pattern or different color pattern on a ground color, said ground color being provided by a disperse dye, said method comprising the steps of:

applying a discharge print paste to said fixed ground-dyed textile material, said print paste consisting essentially of:

a thickening agent;

lithium hydroxide;

an organic acid selected from the group consisting of ethanedioic acid, hydroxyacetic acid, propionic acid, butanedioic acid, butenedioic acid, and mixtures thereof, said organic acid being present in an amount of about 5 to about 10 parts by weight of the print paste;

a polyethylene glycol compound having a molecular weight between 400–8,000, said polyethylene glycol compound being present in an amount between about 5 to about 10 parts by weight of the print paste;

at least one polyoxyethylene sorbitan fatty acid ester wherein the residue of the fatty acid moiety thereof is derived from lauric acid, palmitic acid, stearic acid, or oleic acid, said polyoxyethylene sorbitan fatty acid ester being present in an amount between about 5 to about 10 parts by weight of the print paste; and a polyalkylene glycol ether in an amount between about 3 to about 10 parts by weight of the print paste to a surface of said textile material in a predetermined pattern; and subsequently steaming said textile material at an elevated temperature ranging from about 115° C. to about 210° C. for a time sufficient to discharge the ground color of said textile material to white in those surface areas thereof in contact with said print paste pattern, wherein said ground color is at least one disperse dye selected from Table I or Table II.

10. A method as in claim 9 wherein the textile material includes fibers selected from polyester and polyamide.

11. A method for the discharge printing of a ground-dyed textile material containing synthetic fibers to achieve a white pattern or different color pattern on a ground color, said ground color being provided by a disperse dye, said method comprising the steps of:

applying a discharge print paste to said fixed ground-dyed textile material, said print paste consisting essentially of:

a thickening agent;

lithium hydroxide;

an organic acid selected from the group consisting of ethanedioic acid, hydroxyacetic acid, propionic acid, butanedioic acid, butenedioic acid, and mixtures thereof, said organic acid being present in an amount of about 5 to about 10 parts by weight of the print paste;

a polyethylene glycol compound having a molecular weight between 400–8,000, said polyethylene glycol compound being present in an amount between about 5 to about 10 parts by weight of the print paste;

at least one polyoxyethylene sorbitan fatty acid ester wherein the residue of the fatty acid moiety thereof is derived from lauric acid, palmitic acid, stearic acid, or oleic acid, said polyoxyethylene sorbitan fatty acid ester being present in an amount between of about 5 to about 10 parts by weight of the print paste; and a polyalkylene glycol ether in an amount between about 3 to about 10 parts by weight of the print paste to a surface of said textile material in a predetermined pattern;

subsequently steaming said textile material at an elevated temperature ranging from about 115° C. to about 210° C. for a time sufficient to discharge the ground color of said textile material to white in those surface areas thereof in contact with said print paste pattern, wherein said ground color is at least one disperse dye which is free from carboxylic acid ester group.

12. A method as in claim 11 wherein the ground color is fixed.

13. A method as an claim 11 wherein the ground color also includes at least one reserve color selected from a disperse dye resistant to said print paste so that upon discharge of said ground color, said reserve color remains visible in said print pattern.

14. A method as in claim 13 wherein the reserve color is at least one disperse dye selected from Table III.

15. A method as in claim 11 wherein the print paste further comprises at least one reserve color selected from a disperse dye resistant to said print paste so that upon discharge of said ground shade to white, said reseve color remains visible in said print pattern.

16. A method as in claim 15 wherein the disperse dye resistant to the print paste is at least one disperse dye selected from Table III.

* * * * *